US010543616B2

(12) United States Patent
Harness

(10) Patent No.: US 10,543,616 B2
(45) Date of Patent: Jan. 28, 2020

(54) WOOD CHIPPER WITH OPTIMIZED PRODUCTION CONTROL

(71) Applicant: Astec Industries, Inc., Chattanooga, TN (US)

(72) Inventor: Bradley Simon Harness, Springfield, OR (US)

(73) Assignee: Astec Industries, Inc., Chattanooga, TN (US)

( * ) Notice: Subject to any disclaimer, the term of this patent is extended or adjusted under 35 U.S.C. 154(b) by 417 days.

(21) Appl. No.: 15/449,370

(22) Filed: Mar. 3, 2017

(65) Prior Publication Data

US 2018/0250844 A1 Sep. 6, 2018

(51) Int. Cl.

| | |
|---|---|
| ***B27L 11/02*** | (2006.01) |
| ***B02C 18/22*** | (2006.01) |
| ***B02C 25/00*** | (2006.01) |

(52) U.S. Cl.

CPC ..... *B27L 11/02* (2013.01); *B02C 18/225* (2013.01); *B02C 25/00* (2013.01)

(58) Field of Classification Search

CPC ..... B02C 18/225; B02C 25/00; B27L 11/02
USPC ..... 241/24
See application file for complete search history.

(56) References Cited

U.S. PATENT DOCUMENTS 5,230,475 A * 7/1993 Gerner ..... B02C 13/286 198/626.3
6,446,788 B1 * 9/2002 Leidy ..... C03B 35/062 198/502.4
8,931,721 B2 * 1/2015 Jensen ..... B02C 18/0007 241/100
2002/0070301 A1 6/2002 Stelter et al.
2004/0031363 A1 * 2/2004 Lindee ..... B26D 7/0683 83/73
2004/0112999 A1 * 6/2004 Byram ..... B02C 13/286 241/34
2006/0053990 A1 * 3/2006 Barker ..... B23D 55/046 83/74

(Continued)

FOREIGN PATENT DOCUMENTS

KR 10-2012-0067536 6/2012

OTHER PUBLICATIONS

International Search Report and Written Opinion of counterpart PCT Application No. PCT/US2017/20715 dated Jun. 1, 2017.

*Primary Examiner* — Sean M Michalski
(74) *Attorney, Agent, or Firm* — Chambliss, Bahner & Stophel, P.C.

(57) ABSTRACT

A drum-type wood chipper for processing wood includes a chipper drum that is adapted to rotate about a generally horizontal drum axis, a plurality of cutting blades that are disposed around the periphery of the chipper drum, and an engine that is adapted to rotate the chipper drum about the drum axis. The wood chipper also includes a feed system that is adapted to advance wood to be processed towards the chipper drum, and a controller that is operatively connected to the engine and adapted to determine an instantaneous engine operating rate during rotation of the chipper drum. The controller is also operatively connected to the feed system and adapted to control the rate of advance of wood towards the chipper drum. The controller is also adapted to modify the rate of advance of wood towards the chipper drum as the instantaneous engine operating rate changes while the chipper drum is being rotated.

13 Claims, 6 Drawing Sheets

(56) References Cited

U.S. PATENT DOCUMENTS

| | | | | |
|---|---|---|---|---|
| 2006/0266855 | A1* | 11/2006 | Meyer | B02C 18/16 241/30 |
| 2013/0026266 | A1* | 1/2013 | Morey | B02C 25/00 241/28 |
| 2013/0334346 | A1* | 12/2013 | Morey | B27L 11/00 241/28 |
| 2014/0374520 | A1 | 12/2014 | Wentz et al. | |
| 2015/0090817 | A1* | 4/2015 | Stam | A01F 29/10 241/28 |
| 2015/0217302 | A1* | 8/2015 | Dumpor | B02C 25/00 241/28 |
| 2017/0165674 | A1* | 6/2017 | Harrison | A01G 3/002 |
| 2017/0320067 | A1* | 11/2017 | Helland | B02C 18/14 |
| 2018/0250844 | A1* | 9/2018 | Harness | B27L 11/02 |
| 2019/0054476 | A1* | 2/2019 | Green | B02C 25/00 |

* cited by examiner

WOOD CHIPPER WITH OPTIMIZED PRODUCTION CONTROL

FIELD OF THE INVENTION

The present invention relates generally to a material reduction machine in the nature of a drum-type wood chipper, and more particularly, to a method and apparatus for optimizing the operating rate of such a machine.

BACKGROUND OF THE INVENTION

Material reduction machines in the nature of wood chippers are used to reduce wood to chips of various sizes, depending on their intended use. Generally, such a machine will comprise a reducing assembly having a rotating disk or drum with a plurality of cutting blades mounted around the periphery of the rotating disk or drum. The machine will include an enclosure for the reducing assembly, which enclosure will typically have a feed inlet through which wood materials such as logs and branches to be reduced are introduced, and a discharge outlet through which the chips are discharged after reduction. The use of wood chippers avoids the environmental and other problems associated with burning trees and brush for disposal, or with disposing of them in a landfill. Furthermore, by reducing wood to chips of a useful size, a wood chipper may be employed to produce a valuable chip product. Wood chips can be used as mulch or fuel. They can also be used as raw material for creating a pelletized fuel product or as raw material in a chemical pulp process.

Disk-type wood chippers include blades mounted on a rotating disk that cut across the grain of the wood stem generally perpendicular to the direction of the grain. Drum-type wood chippers include cutting blades mounted around the circumferential wall of a cylindrical chipper drum that cut across the wood feed stock in a path that varies with respect to the orientation of the grain of the feed stock to the drum.

Generally, a drum-type wood chipper includes a feed mechanism, a chipper drum that is partially enclosed in a housing, and a discharge chute. The chipper drum has a circumferential wall and is mounted for rotation on a shaft by means of an internal combustion engine or other driver engine. A plurality of cutting blades, each having a leading edge, are spaced around the circumferential wall of the chipper drum. As the drum rotates, the leading edges of the blades cut an arc that is concentric with and of a larger diameter than the circumferential wall of the drum. The feed mechanism carries woody material to be chipped into contact with the cutting blades on the chipper drum.

Uniformly sized chips are preferred for certain uses. The chips produced by a drum-type wood chipper will be of a generally uniform size if the rotational speed of the chipper drum, the extension of each blade from the circumferential wall of the drum, and the feed speed of material to the chipper drum are controlled so that the wood moves a precise distance toward the chipper drum during the time it takes for the drum to rotate from the completion of the cutting of a chip by a blade to the beginning of the cutting of a chip by the next blade mounted on the circumferential wall of the drum. However, the presentation of wood to the chipper drum by the feed mechanism causes resistance against the rotation of the chipper drum, and this resistance will slow the rate of rotation of the drum. When the rotational rate of the chipper drum slows, the operator of the wood chipper may reduce the rate of advance of wood to the chipper drum by the feed mechanism in an attempt to maintain the desired chip size. This feed mechanism speed response to resistance-induced chipper drum rotational rate changes is often effective for small changes in the rotational rate of the chipper drum. However, if the resistance created by the presentation of wood to the chipper drum is large or is generated rapidly, the operator of a conventional wood chipper may not be able to reduce the feed mechanism speed quickly enough to avoid stalling of the engine that drives the chipper drum. Consequently, conventional wood chippers are typically operated so that the feed mechanism will stop when resistance to the rotation of the chipper drum slows the driver engine to a predetermined lower operating rate. Then when the engine, operating under reduced load, recovers so that the rotational rate of the chipper drum returns to a desirable operational level, the feed mechanism will again be operated to advance wood towards the chipper drum. This method of operation is sometimes referred to as "chipping mode". Operating a wood chipper in chipping mode results in chips of a uniform size, but at a lower production rate than would be obtained if it were not necessary to stop the advance of the wood to the chipper drum from time to time.

Another conventional method of operation is to operate the feed mechanism so as to reduce the rate of advance of wood to the chipper drum faster than the rate of reduction of the rotational rate of the chipper drum as the chipper drum slows due to resistance. This method of operation, which is sometimes referred to as "grinding mode", will insure that the engine driving the chipper drum will not stall; however, chips produced using this method will not be uniform in size, even though the overall production quantity will be increased over what may be obtained using a chipping mode of operation.

It would be desirable if a method and apparatus for operating a drum-type wood chipper could be provided that would allow for operation at a higher production rate than a machine operating in chipping mode, while maintaining acceptable chip size uniformity.

ADVANTAGES OF THE INVENTION

Among the advantages of a preferred embodiment of the invention is that it provides a drum-type wood chipper that operates at a higher production rate than a machine operating in chipping mode, while maintaining acceptable chip size uniformity. Other advantages and features of this invention will become apparent from an examination of the drawings and the ensuing description.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

Terms concerning attachments, coupling and the like, such as "connected" and "interconnected", refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

The term "downstream", as used herein to describe a relative position on or in connection with a drum-type wood chipper or a component thereof, refers to a relative position in the direction of the movement of wood or wood chips through the wood chipper or component thereof.

The term "engine" refers to an internal combustion engine or other device that is operatively connected to the cutting drum of a drum-type wood chipper and adapted to generate the power for rotating the cutting drum during operation of the machine.

SUMMARY OF THE INVENTION

The invention comprises a drum-type wood chipper comprising a chipper drum assembly including a chipper drum with a plurality of cutting blades that are disposed around the periphery of the chipper drum and an engine that is adapted to rotate the chipper drum about a generally horizontal drum axis. The chipper drum has a chipper drum radius, and the plurality of cutting blades have leading edges that define a chipping arc of rotation as the chipper drum rotates, which chipping arc of rotation has a radius that is larger than the chipper drum radius by a predetermined amount. The drum-type wood chipper includes a feed system that is adapted to advance wood to be processed towards the chipper drum, and a controller. The controller is operatively connected to the engine and adapted to determine an instantaneous engine operating rate during rotation of the chipper drum. The controller is also operatively connected to the feed system and adapted to control the rate of advance of wood towards the chipper drum. The controller is also adapted to modify the rate of advance of wood towards the chipper drum as the instantaneous engine operating rate changes while the chipper drum is being rotated.

In a preferred embodiment of the invention, an operator of the machine may enter information into the controller by means of a controller interface. Such information may include a desired maximum engine operating rate and a desired minimum engine operating rate. In this embodiment of the invention, the controller is operatively connected to the controller interface and adapted to receive the maximum engine operating rate entered by the operator and the minimum engine operating rate entered by the operator. In this embodiment of the invention, the controller is adapted to determine a grinding mode rate of decline of the speed of the feed system as the engine operating rate decreases during operation of the wood chipper from a maximum predetermined engine operating rate to a minimum predetermined engine operating rate, and to determine a chipping mode rate of decline of the speed of the feed system as the engine operating rate decreases during operation of the wood chipper from the maximum engine operating rate to the minimum engine operating rate. The controller will cause the speed of the feed system to decline at the chipping mode rate of decline as the engine operating rate decreases from the maximum engine operating rate to a predetermined intermediate engine operating rate, and it will cause the speed of the feed system to decline at a rate that is greater than the chipping mode rate but less than the grinding mode rate as the engine operating rate decreases from the intermediate engine operating rate.

The preferred embodiment of the invention also comprises a method of operating a wood chipper such as is described above at a higher production rate than a machine operating in chipping mode, while maintaining acceptable chip size uniformity. This method takes advantage of the fact that as resistance causes the rotational rate of the chipper drum to slow, the operating rate of the engine that is operatively connected to the chipper drum will also slow. Preferably, the wood chipper is operated so as to maintain a desired relationship between the rate of advance of wood towards the chipper drum and the engine operating rate.

According to a preferred embodiment of the method, the controller is adapted to determine a grinding mode rate of decline of the speed of the feed system as the engine operating rate decreases during operation of the wood chipper from a maximum predetermined engine operating rate to a minimum predetermined engine operating rate, and to determine a chipping mode rate of decline of the speed of the feed system as the engine operating rate decreases during operation of the wood chipper from the maximum engine operating rate to the minimum engine operating rate. The controller causes the speed of the feed system to decline at the chipping mode rate of decline as the engine operating rate decreases from the maximum engine operating rate to a predetermined intermediate engine operating rate, and it causes the speed of the feed system to decline at a rate that is greater than the chipping mode rate but less than the grinding mode rate as the engine operating rate decreases from the intermediate engine operating rate.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the particular apparatus illustrated herein. Therefore, the scope of the invention contemplated by the inventors includes all equivalents of the subject matter recited in the claims, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and wherein.

DESCRIPTION OF THE PREFERRED EMBODIMENTS OF THE INVENTION

Figure 1:
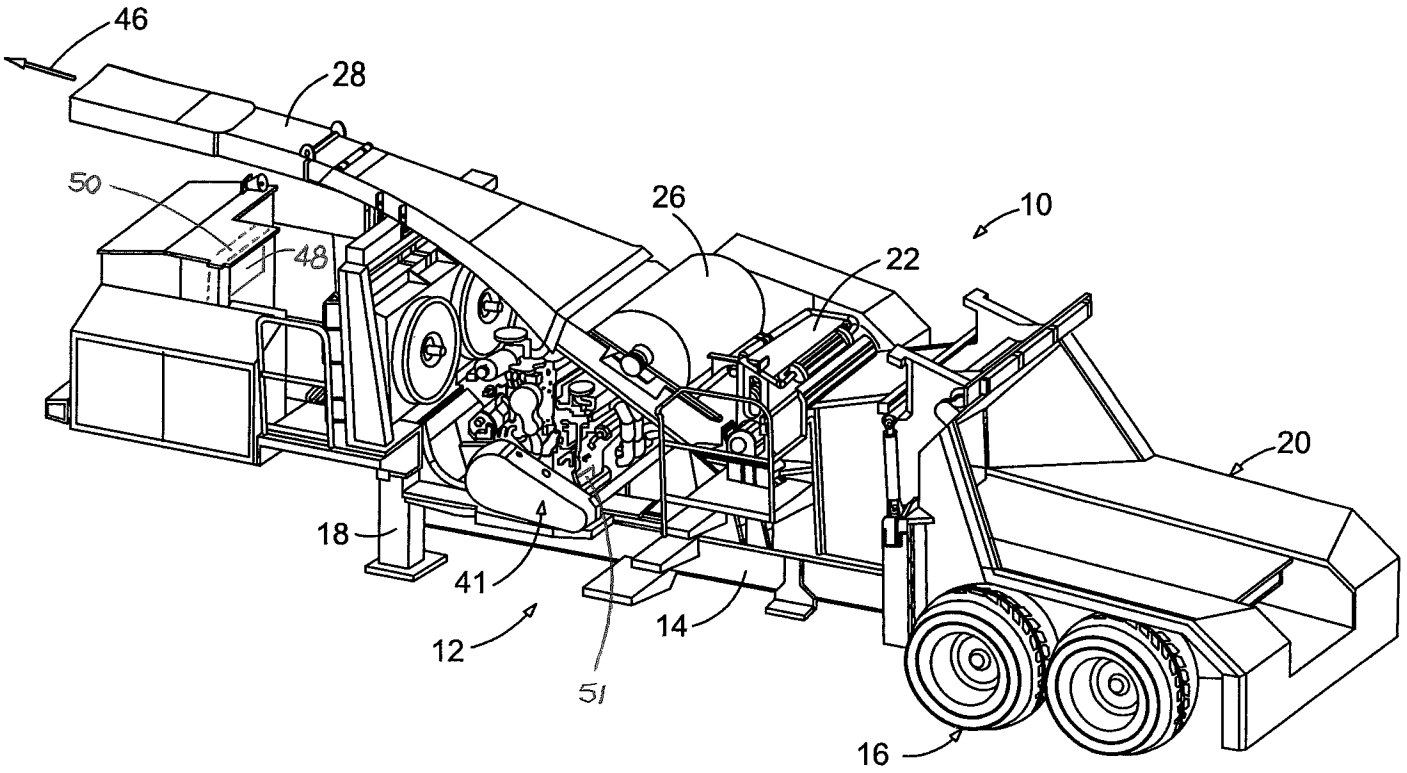
FIG. 1 is a perspective view of a drum-type wood chipper that may be operated according to the invention.

This description of preferred embodiments of the invention is intended to be read in connection with the accompanying drawings, which are to be considered part of the entire written description of this invention. The drawing figures are not necessarily to scale, and certain features of the invention may be shown exaggerated in scale or in somewhat schematic form in the interest of clarity and conciseness.

Figure 2:
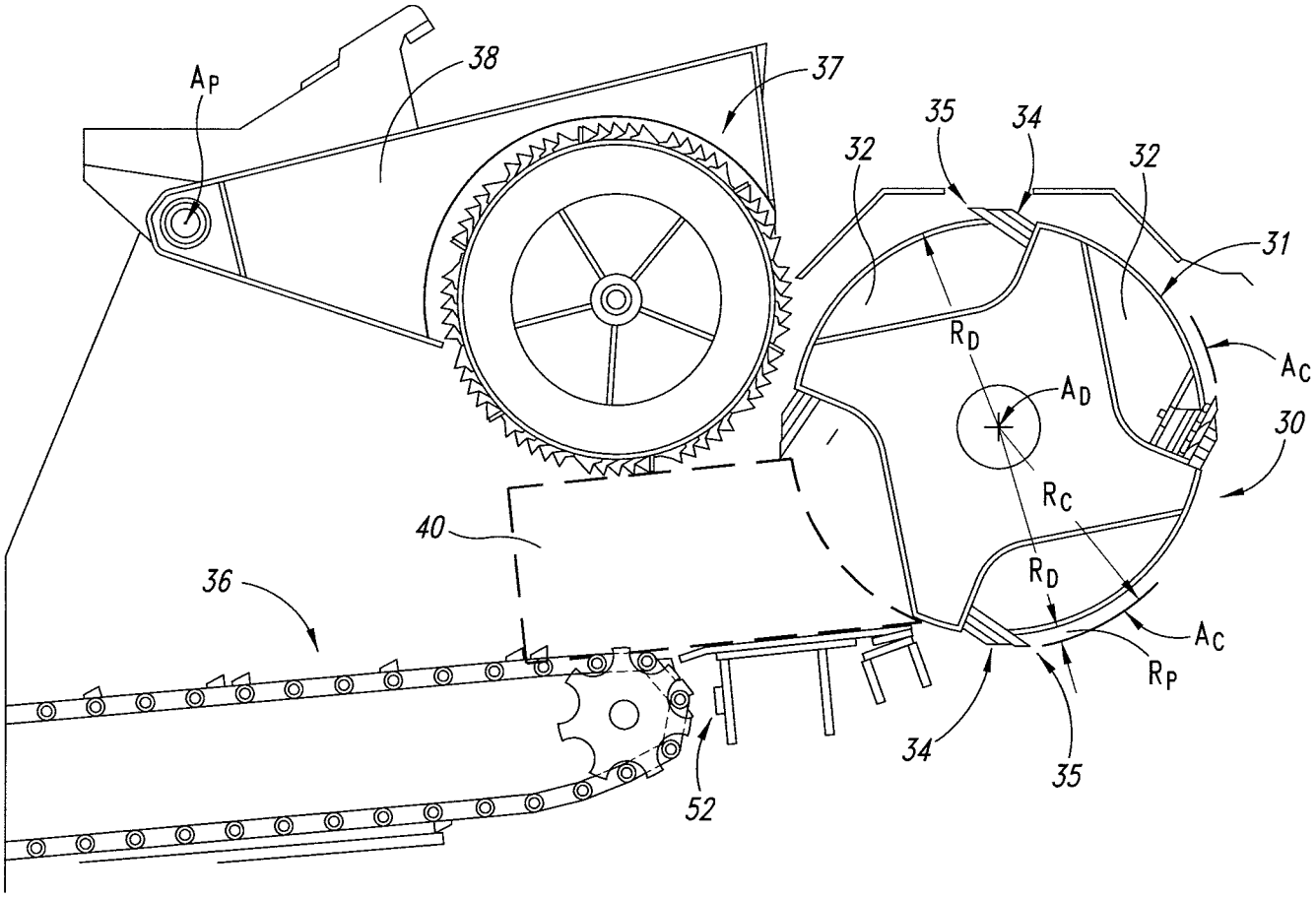
FIG. 2 is a schematic sectional view of a portion of the chipper drum assembly and certain components of the feed system that are adapted to advance wood to be processed towards the chipper drum, showing a log that is positioned for operation of the wood chipper in chipping mode.
Figure 4:
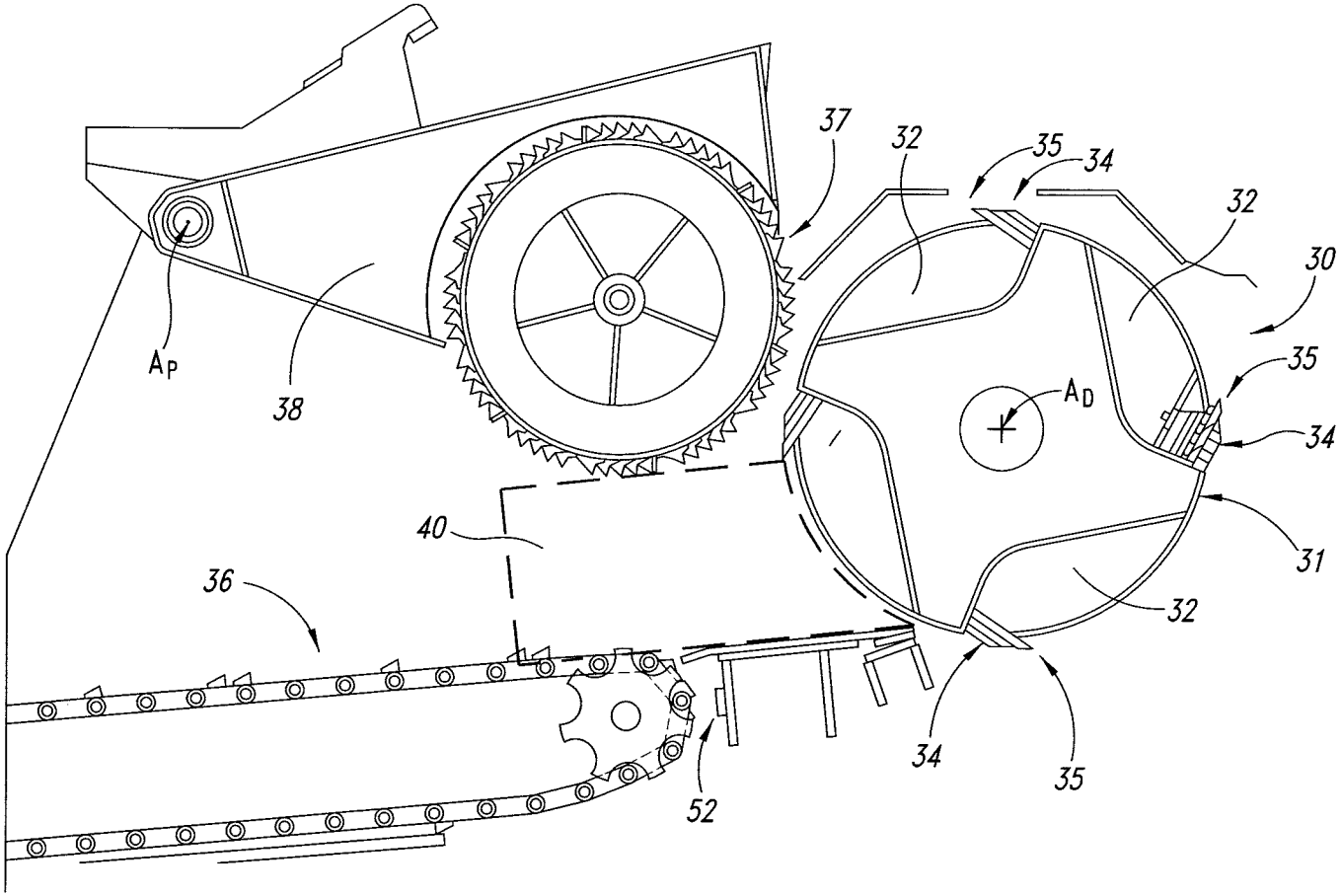
FIG. 4 is a schematic sectional view of a portion of the chipper drum assembly and certain components of the feed system that are adapted to advance wood to be processed towards the chipper drum, showing a log that is positioned for operation of the wood chipper in grinding mode.

As shown in FIGS. 1, 2 and 4, a preferred embodiment of the invention comprises a drum-type wood chipper 10 which includes trailer 12 that is adapted to be pulled by a tractor or other vehicle. Trailer 12 includes frame 14 that is supported by wheels 16 and a pair of adjustable support legs, one of which, support leg 18, is shown in FIG. 1. In other embodiments of the invention, the wood chipper can be mounted on a self-propelled frame or chassis, or on a fixed frame. Supported on frame 14 of trailer 12 are feed chute 20 and a chipper drum assembly that is partially enclosed by chipper drum housing 22. Accelerator wheel housing 26 houses an accelerator wheel (not shown) downstream of chipper drum housing 22, and discharge chute 28 is located downstream of the accelerator wheel. Other embodiments of the invention omit the accelerator wheel and its housing, and locate the discharge chute adjacent to the chipper drum assembly.

The chipper drum assembly includes chipper drum 30 that is mounted for rotation (in the counter-clockwise direction, as shown in FIGS. 2 and 4) about generally horizontal drum axis $A_D$. Chipper drum 30 includes circumferential wall 31 defining chipper drum radius $R_D$, and a plurality of pockets 32 that are spaced around the periphery of chipper drum 30 within circumferential wall 31. A plurality of cutting blades 34, each of which has a leading edge 35, are disposed around the periphery of chipper drum 30.

In the embodiment of the invention illustrated in the drawings, a cutting blade 34 is mounted on each of the pockets so that as chipper drum 30 rotates, the leading edges 35 of the plurality of cutting blades 34 define a chipping arc of rotation $A_C$ that is parallel to circumferential wall 31 and has a larger radius than the radius $R_D$ of the circumferential wall. Consequently, chipping arc of rotation Ac has a radius $R_C$ that is larger than the chipper drum radius $R_D$ by a predetermined amount $R_P$, as can be seen in FIG. 2.

A feed system is provided to advance wood to be processed towards chipper drum 30. As shown in FIGS. 2 and 4, the preferred feed system includes feed conveyor 36 and compression roller 37. In this embodiment of the invention, compression roller 37 is mounted on pivotal arm 38, which is adapted to pivot about pivot axis $A_P$ with respect to the frame of wood chipper 10. Compression roller 37 is adapted to be urged generally downwardly towards feed conveyor 36 and cooperates with feed conveyor 36 to align and urge a log such as log 40 towards chipper drum 30.

Engine 41 is also mounted on frame 14 of wood chipper 10, and is adapted to provide a rotational force to chipper drum 30 within chipper drum housing 22 by means of one or more drive belts or other conventional drive transfer mechanisms (not shown). In the embodiment of the invention illustrated in the drawings, engine 41 is also adapted to provide a rotational force to the accelerator wheel within accelerator wheel housing 26, which rotates in the same direction as chipper drum 30 by means of one or more drive belts or other conventional drive transfer mechanisms (not shown). The accelerator wheel acts to increase the momentum of chips produced by chipper drum 30 into (and out of) discharge chute 28 along discharge path 46.

Controller interface 48 is provided by which an operator may enter operating parameters for wood chipper 10 into controller 50. Controller 50 may embody a single microprocessor or multiple microprocessors that include components for controlling operations of wood chipper 10 based on input from an operator of the wood chipper and on sensed or other known operational parameters. Controller 50 may include a memory, a secondary storage device, a processor and other components for running an application. Various other circuits may be associated with controller 50 such as power supply circuitry, sensor signal circuitry, signal conditioning circuitry, solenoid driver circuitry and other types of circuitry. Numerous commercially available microprocessors can be configured to perform the functions of controller 50. It should be appreciated that controller 50 could readily be embodied in a general purpose computer or machine microprocessor capable of controlling numerous machine functions.

Controller 50 is operatively connected to engine sensor 51 (shown in FIG. 1) for determining the instantaneous operating rate of engine 41. Controller 50 is operatively connected to feed rate sensor 52 (shown in FIGS. 2 and 4) or to another sensor (not shown) for determining the linear speed of conveyor 36. Controller 50 is also operatively connected to a conventional drive system for feed conveyor 36 and is adapted to modify the linear speed of the feed conveyor. Controller 50 may also be operatively connected to engine 41 and adapted to modify the rotational speed of the cutting drum by modifying the engine operating rate.

Examples of information that may be input into controller 50 by an operator through controller interface 48 are the chipper drum radius $R_D$, the number and spacing of cutter blades mounted on the chipper drum, and the measured gap $R_P$ between the chipper drum radius $R_D$ and the chipping arc of rotation radius $R_C$. The operator may also enter a maximum engine operating rate and a minimum engine operating rate, and the beginning rate of advance of wood to the chipper drum. In some embodiments of the invention, the operator may enter a desired relationship, in the form of a ratio or a formula, between the rate of advance of wood towards the chipper drum (i.e., the speed of the feed conveyor) and the engine operating rate.

Figure 3:
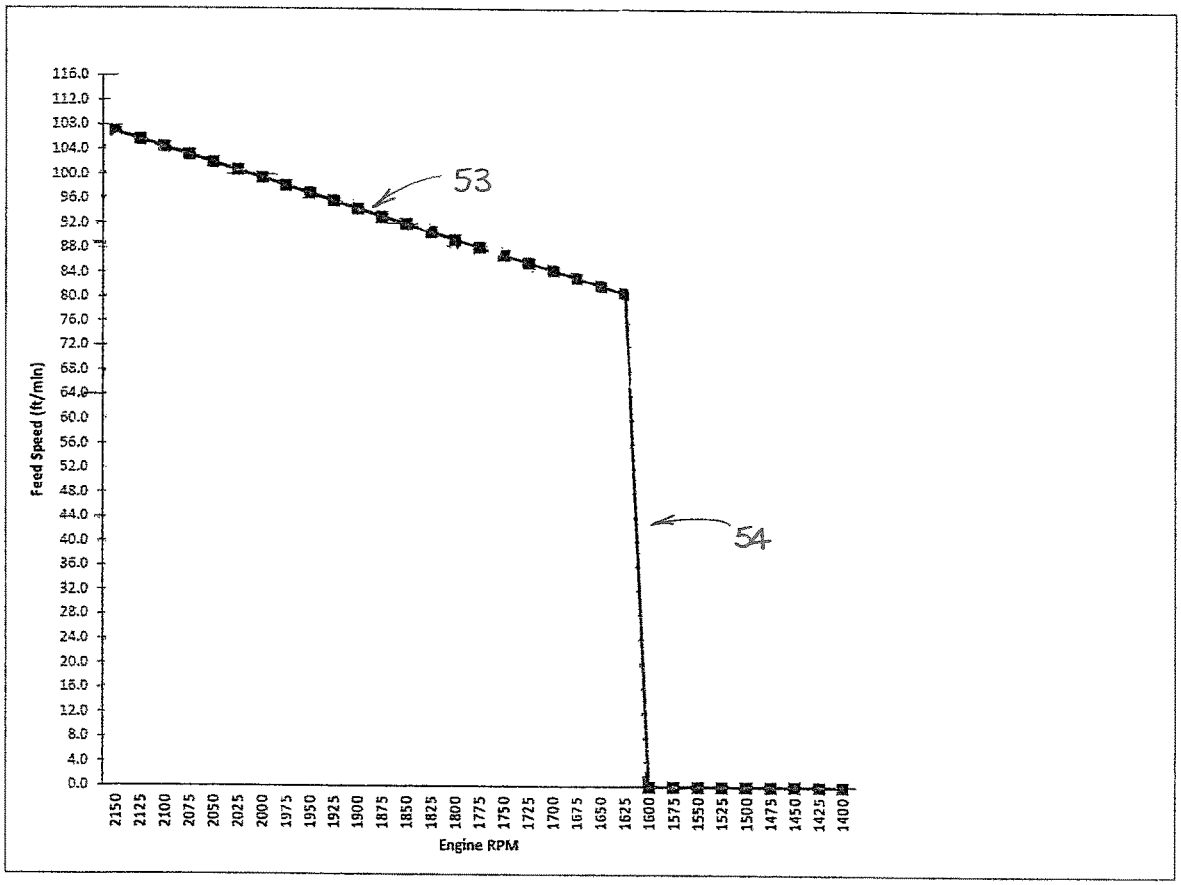
FIG. 3 is an exemplary graphical representation of the operation of a drum-type wood chipper in chipping mode.

A wood chipper such as wood chipper 10 may be operated in a chipping mode in order to produce chips of a uniform size, without attempting to maximize an overall production rate. FIG. 2 illustrates the presentation of log 40 to chipping drum 30 according to a chipping mode of operation. In carrying out a chipping mode of operation, certain operating parameters must be strictly controlled, including the rotational speed of the chipper drum (which is based in part on the number and spacing of cutting blades mounted around the periphery of the chipper drum and the size of the gap $R_P$ between the chipper drum radius $R_D$ and the chipping arc of rotation radius $R_C$) and the rate of advance of wood to be chipped to the chipper drum. However, as has been described hereinabove, the presentation of a log to the chipper drum for the cutting of chips causes resistance that reduces the rate of rotation of the chipper drum and increases the load on the engine. The amount of resistance generated depends primarily on the rate of advance of the wood to the chipper drum. If this resistance is significant, the engine will not be able to maintain the desired rotational speed of the chipper drum, and the chipper drum will slow. When a wood chipper is operated in a chipping mode, as shown in an exemplary embodiment in FIG. 3, the operator can attempt to reduce the rate of advance of the wood to be chipped proportionally to the rate of reduction of the engine operating rate for the portion of the operating cycle indicated by line segment 53, in order to maintain the desired chip size. Thus, for example, FIG. 3 illustrates a chipping mode method of control, wherein the maximum (or beginning) engine operating rate is set at 2150 rpm, and the beginning rate of advance of wood to the chipper drum is set at 108 ft/min. As shown in FIG. 3, a wood chipper may be operated so that the rate of advance of wood to the chipper drum falls in response to the rate of reduction of the engine operating rate from the initial rate of 108 ft/min. at the beginning engine operating rate, in a linear fashion represented by line segment 53 according to the formula $y=0.05x$ (where y is the feed speed in ft/min. and x is the engine operating rate in rpm) to 80 ft/min at the minimum engine operating rate of 1600 rpm, which is the rate at which the advance of wood to the chipper drum is stopped in order to avoid stalling of the engine. This stoppage of the advance of wood to the chipper drum is characteristic of a chipping mode of operation, since reducing the rate of advance of wood to the chipper drum is not always effective to maintain uniform chip size when the load imposed on the engine by resistance occurs suddenly or is particularly large. This stoppage of the advance of wood to the chipper drum when the operating rate of the engine falls to the predetermined limit of 1600 rpm is indicated by line segment 54 of FIG. 3. Thereafter, when the engine, operating under reduced load, recovers to an operating rate that provides an acceptable rate of rotation of the chipper drum, the operator may operate the feed system to resume the advance of the wood to the chipper drum.

Figure 5:
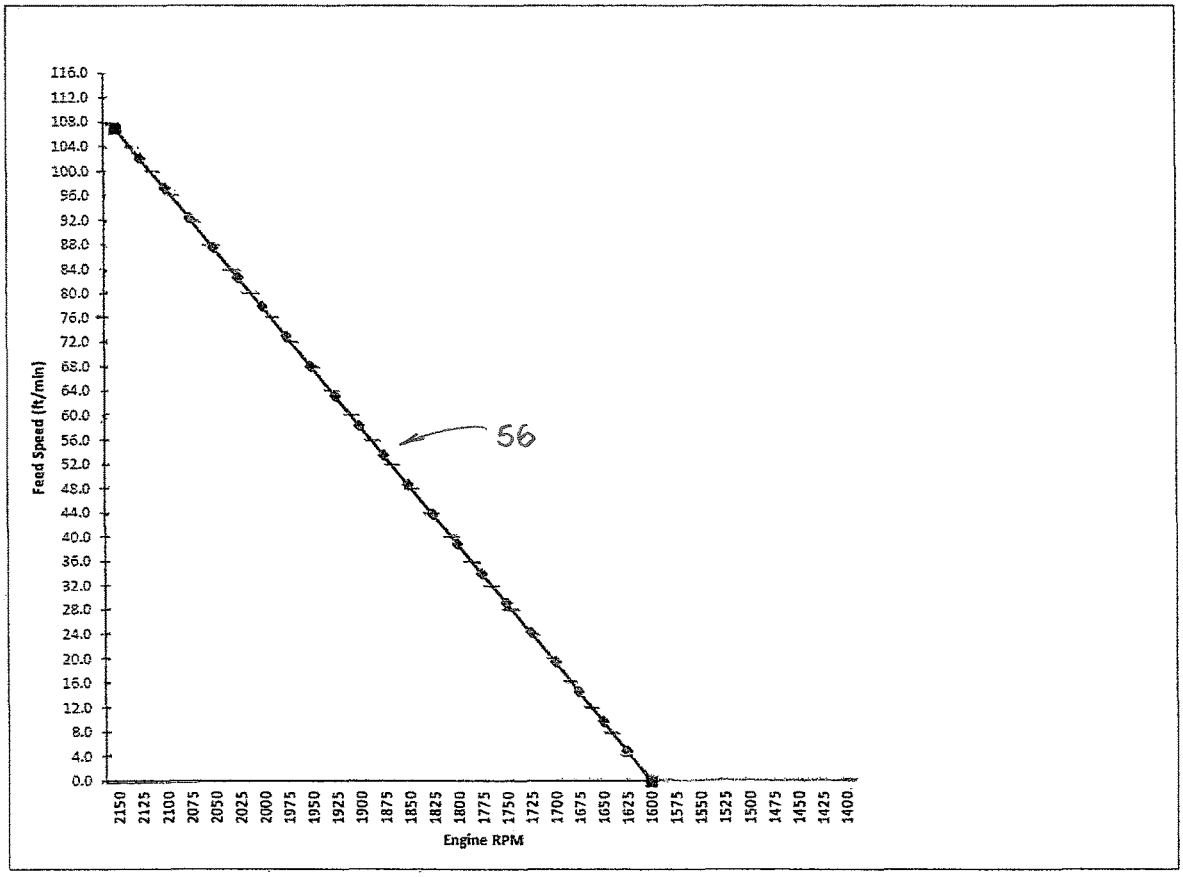
FIG. 5 is an exemplary graphical representation of the operation of a drum-type wood chipper in grinding mode.

A wood chipper such as wood chipper 10 may also be operated in a grinding mode in order to maximize an overall production rate and avoid engine stalling. FIG. 4 illustrates the presentation of log 40 to chipping drum 30 according to a grinding mode of operation. By comparing the position of log 40 with respect to the chipping drum in FIG. 4 with the position of the log to the chipping drum as shown in FIG. 2, the difference in presentation between a chipping mode of operation and a grinding mode of operation can be appreciated. When operating in a grinding mode, the rate of advance of wood to the chipper drum is reduced at a greater rate than the rate of reduction of the rotational speed of the chipper drum that is caused by resistance. This method of operation will insure that the engine will not stall; however, chips produced using this method will not be uniform in size, even though the overall production quantity will be increased over what may be obtained using a chipping mode of operation. When a wood chipper is operated in a grinding mode, as shown in an exemplary embodiment in FIG. 5, the rate of advance of the wood to be chipped is reduced at a greater rate than the rate of reduction of the engine operating rate for the operating cycle indicated by line segment 56, in order to avoid engine stalling. Thus, for example, FIG. 5 illustrates a grinding mode method of control, wherein the maximum (or beginning) engine operating rate is set at 2150 rpm, and the beginning rate of advance of wood to the chipper drum is set at 108 ft/min. As shown in FIG. 5, the rate of advance of wood to the chipper drum is reduced from the initial rate of 108 ft/min. at the beginning engine operating rate, in a linear fashion represented by line segment 56 according to the formula $y=0.194x-310$ (where y is the feed speed in ft/min. and x is the engine operating rate in rpm) to 0 ft/min at the minimum engine operating rate of 1600 rpm. This mode of operation maximizes the overall production rate of the wood chipper, but does not result in the production of chips of uniform size.

The preferred embodiment of the invention comprises a controller and control method for a wood chipper which allows operation at a higher production rate than a machine operating in a typical chipping mode, while maintaining relative chip size uniformity at a much greater level than could be obtained from operation in a typical grinding mode. The controller is adapted to monitor the instantaneous engine operating rate during rotation of chipper drum, and to modify the rate of advance of wood towards the chipper drum as the instantaneous engine operating rate changes while the chipper drum is being rotated. Preferably, the controller is adapted to modify the rate of advance of wood towards the chipper drum in order to maintain a desired relationship between the rate of advance of wood towards the chipper drum and the engine operating rate.

Figure 6:
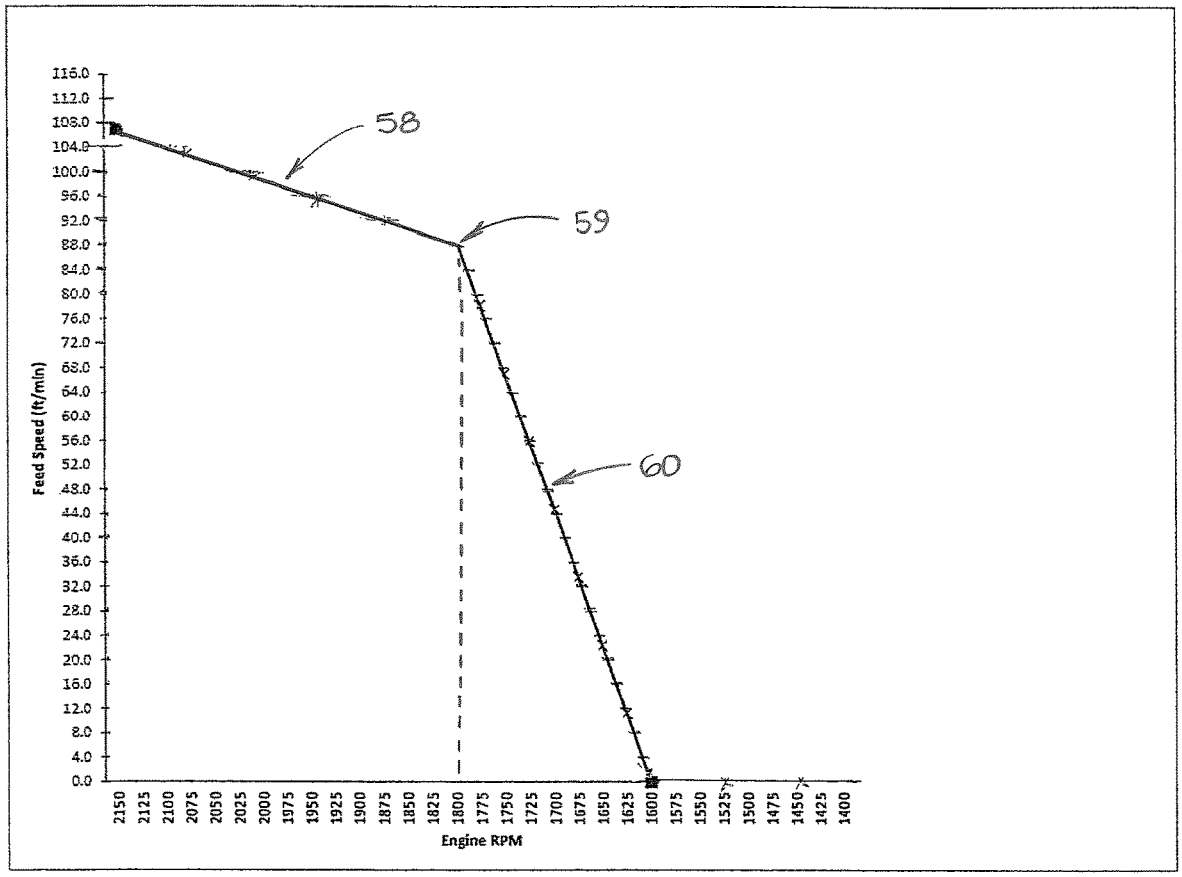
FIG. 6 is an exemplary graphical representation of the operation of a drum-type wood chipper according to a preferred embodiment of the invention.

Controller 50 is operatively connected to controller interface 48 and adapted to receive a predetermined maximum engine operating rate that is entered by the operator, a predetermined minimum engine operating rate and a predetermined intermediate engine operating rate between the predetermined maximum and the predetermined minimum rates. The intermediate engine operating rate for this control method is set by the operator so as to account for field conditions and wood type and to optimize chip product uniformity and production rate according to desired production and chip uniformity requirements. Controller 50 is also adapted to receive a beginning rate of advance of the feed system that is entered by the operator In one embodiment of the invention, the controller is adapted to reduce the speed of the feed conveyor at a first rate as the engine operating rate decreases during operation of the wood chipper from the maximum engine operating rate to an intermediate engine operating rate, and at a second rate which is greater (i.e., steeper) than the first rate as the engine operating rate decreases from the intermediate engine operating rate. In this embodiment of the invention, the controller is adapted to reduce the speed of feed conveyor 36 at a first rate as the engine operating rate decreases during operation of the wood chipper from the maximum engine operating rate to the intermediate engine operating rate, as illustrated by line segment 58 of FIG. 6, and at a second rate which is greater (i.e., steeper) than the first rate as the engine operating rate decreases from the intermediate engine operating rate (indicated at 59 in FIG. 6), as illustrated by line segment 60 of FIG. 6.

In one embodiment of the invention, the controller monitors the instantaneous engine operating rate during rotation of chipper drum 30, and causes the speed of the feed system to decline at a calculated chipping mode rate of decline as the resistance-induced decline in the rotational speed of the chipper drum causes the engine operating rate to decrease from the maximum engine operating rate to a predetermined intermediate engine operating rate, and it causes the speed of the feed system to decline at a rate that is greater than the chipping mode rate but less than a calculated grinding mode rate as the engine operating rate decreases from the intermediate engine operating rate. In this mode of operation, the advance of wood to the chipper drum does not cause the engine to stall except under the most severe conditions. Operation of a wood chipper according to this control method allows for a high production rate with a limited amount of non-uniformly sized chips. The small compromise in chip uniformity is offset by higher production than is obtained by a wood chipper operating in chipping mode.

According to one embodiment of the invention, controller 50 is adapted to receive a predetermined maximum engine operating rate, such as, for example, 2150 rpm, that is entered by the operator, a predetermined minimum engine operating rate, such as for example, 1600 rpm, and a predetermined intermediate engine operating rate between the predetermined maximum and the predetermined minimum rates, such as for example, 1800 rpm. The intermediate engine operating rate for this control method may be set by the operator so as to take into consideration field conditions and wood type and to optimize chip product uniformity and production rate according to desired production and chip uniformity requirements. In this embodiment of the invention, controller 50 is also adapted to receive a beginning rate of advance of the feed system, such as, for example, 108 ft/min., that is entered by the operator. The controller is adapted to reduce the speed of feed conveyor 36 at a first rate as the engine operating rate decreases during operation of the wood chipper from the maximum engine operating rate to the intermediate engine operating rate, as illustrated by line segment 58 of FIG. 6, and at a second rate which is greater (i.e., steeper) than the first rate as the engine operating rate decreases from the intermediate engine operating rate (indicated at 59 in FIG. 6), as illustrated by line segment 60 of FIG. 6.

In one embodiment of the invention, the controller is adapted to determine or calculate a chipping mode rate of decline of the speed of the feed system as the engine operating rate decreases during operation of the wood chipper from the maximum engine rotation rate to the minimum engine rotation rate. Such a rate is illustrated by line segment 58 of FIG. 6, which is shorter than, but at the same slope as, line segment 53 of FIG. 3. The controller in this embodiment of the invention is also adapted to determine or calculate a grinding mode rate of decline of the speed of the feed system as the engine operating rate decreases during operation of the wood chipper from the maximum engine rotation rate to the minimum engine rotation rate. Such a rate is illustrated by line segment 56 of FIG. 5. Then, when the engine operating rate falls under load, the controller will cause the speed of the feed system to decline according to the calculated chipping mode of operation, to the predetermined intermediate rate of 88 ft/min. as indicated by point 59 of FIG. 6. The controller will thereafter cause the speed of the feed system to decline at a rate that is greater than the calculated chipping mode rate but less than the calculated grinding mode rate as the engine operating rate decreases from the intermediate engine rotation rate. Such a rate of decline of the feed conveyor as the engine operating rate decreases is illustrated by line segment 60 of FIG. 6. Its slope may be compared to that of line 54 of FIG. 3 and that of line segment 56 of FIG. 5.

Although this description contains many specifics, these should not be construed as limiting the scope of the invention, but as merely providing illustrations of the presently preferred embodiment thereof, as well as the best mode contemplated by the inventors of carrying out the invention. The invention, as described herein, is susceptible to various modifications and adaptations, as would be understood by those having ordinary skill in the art to which the invention relates.

What is claimed is:

1. A drum-type wood chipper for processing wood, said wood chipper comprising:

a) a chipper drum assembly comprising:
   i) a chipper drum having a chipper drum radius, said chipper drum being adapted to rotate about a generally horizontal drum axis;
   ii) an engine that is adapted to rotate the chipper drum about the drum axis;
   iii) a plurality of cutting blades that are disposed around the periphery of the chipper drum, said plurality of cutting blades having leading edges that define a chipping arc of rotation as the chipper drum rotates, said chipping arc of rotation having a radius that is larger than the chipper drum radius by a predetermined amount;

b) a feed system having a feed conveyor for advancing wood to be processed towards the plurality of cutting blades of the chipper drum;

c) a controller that is:
   i) adapted to receive a maximum engine operating rate, a minimum engine operating rate, and an intermediate engine operating rate that is between the maximum engine operating rate and the minimum engine operating rate;
   ii) operatively connected to the engine and adapted to determine an instantaneous engine operating rate during rotation of the chipper drum;
   iii) operatively connected to the feed system and adapted to control a rate of advance of wood towards the chipper drum;
   iv) adapted to modify a linear speed of the feed conveyor in a first direction advancing wood towards the chipper drum in response to changes in the instantaneous engine operating rate while the chipper drum is being rotated;
   (v) adapted to cause the linear speed of the feed conveyor in the first direction to decline at a first rate of decline as the engine operating rate decreases from the maximum engine operating rate to the intermediate engine operating rate; and
   (vi) adapted to cause the linear speed of the feed conveyor in the first direction to decline at a second rate of decline that is greater than the first rate of decline as the engine operating rate decreases from the intermediate engine operating rate and without changing the direction of the feed conveyor.

2. The drum-type wood chipper of claim 1 wherein:

a) the feed system includes a feed conveyor having a feed conveyor drive system;

b) the controller is:
  i) operatively connected to an engine sensor for determining the instantaneous operating rate of the engine;
  ii) operatively connected to a feed rate sensor for determining the linear speed of the feed conveyor;
  iii) operatively connected to the drive system for the feed conveyor;
  iv) adapted to modify the linear speed of the feed conveyor as the instantaneous engine operating rate changes while the chipper drum is being rotated.

3. The drum-type wood chipper of claim 1 wherein the controller is adapted to:
a) determine a grinding mode rate of decline of the linear speed of the feed conveyor as the engine operating rate decreases during operation of the wood chipper from the maximum engine operating rate to the minimum operating rate;
b) determine a chipping mode rate of decline of the speed of the feed conveyor as the engine operating rate decreases during operation of the wood chipper from the maximum engine operating rate to the minimum engine operating rate;
c) cause the linear speed of the feed conveyor to decline at the chipping mode rate of decline as the engine operating rate decreases from the maximum engine operating rate to the intermediate engine operating rate;
d) cause the linear speed of the feed conveyor to decline at a rate that is greater than the chipping mode rate but less than the grinding mode rate as the engine operating rate decreases from the intermediate engine operating rate.

4. The wood chipper of claim 1 wherein the controller is adapted to operate the feed system at a feed rate of zero once the engine operating rate is less than the minimum engine operating rate.

5. A method of operating a drum-type wood chipper for processing wood, said method comprising the steps of:
a) providing a chipper drum assembly including a chipper drum having a chipper drum radius, said chipper drum being adapted to rotate about a generally horizontal drum axis;
b) providing an engine that is adapted to rotate the chipper drum about the drum axis;
c) providing a plurality of cutting blades around the periphery of the chipper drum, said plurality of cutting blades having leading edges that define a chipping arc of rotation as the chipper drum rotates, said chipping arc of rotation having a radius that is larger than the chipper drum radius by a predetermined amount;
d) providing a feed system that advances wood to be processed towards the chipper drum, said feed system including a feed conveyor having a feed conveyor drive system;
e) providing a feed rate sensor for determining an instantaneous rate of advance of wood towards the chipper drum as the feed conveyor drive system is operated;
f) providing an engine sensor for determining an instantaneous operating rate of the engine as the chipper drum is rotated;
g) providing a controller that is:
  i) operatively connected to the engine sensor and adapted to determine an instantaneous engine operating rate during operation of the engine to rotate the chipper drum;
  ii) operatively connected to the feed conveyor drive system and adapted to control the rate of advance of wood towards the chipper drum;
  iii) adapted to modify the linear speed of advance of wood towards the chipper drum depending on the instantaneous engine operating rate while the engine is being operated to rotate the chipper drum;
h) operating the controller to modify the rate of advance of wood towards the chipper drum as the instantaneous engine operating rate changes while the chipper drum is being rotate;
i) providing a controller interface that is operatively connected to the controller;
j) entering a maximum engine operating rate, minimum engine operating rate, and intermediate engine operating rate into the controller via the controller interface;
k) operating the controller to cause the speed of the feed system to decline at a first rate of decline as the engine operating rate decreases from the maximum engine operating rate to the intermediate engine operating rate;
l) operating the controller to cause the speed of the feed system to decline at a second rate of decline that is greater than the first rate to a non-zero speed as the engine operating rate decreases from the intermediate engine operating rate and without changing the direction of the feed conveyor.

6. The method of claim 5 which includes:
a) providing a controller that is adapted to:
  i) determine a grinding mode rate of decline of the speed of the feed system as the engine operating rate decreases during operation of the wood chipper from the maximum engine operating rate to the minimum engine operating rate;
  ii) determine a chipping mode rate of decline of the speed of the feed system as the engine operating rate decreases during operation of the wood chipper from the maximum engine operating rate to the minimum engine operating rate;
b) operating the controller so as to:
  i) cause the speed of the feed system to decline at the chipping mode rate of decline as the engine operating rate decreases from the maximum engine operating rate to the intermediate engine operating rate;
  ii) cause the speed of the feed system to decline at a rate that is greater than the chipping mode rate but less than the grinding mode rate as the engine operating rate decreases from the intermediate engine operating rate.

7. The method of claim 5 further comprising the step operating the feed conveyor at a feed rate of zero once the engine operating rate is less than the minimum engine operating rate.

8. A method of operating a drum-type wood chipper for processing wood, said method comprising the steps of:
a) providing a chipper drum assembly having a chipper drum with a plurality of cutting blades;
b) rotating the chipper drum with an engine;
c) advancing wood to be processed towards the plurality of cutting blades of the chipper drum with a feed conveyor of a feed system;
d) determining an instantaneous rate of advance of the wood towards the chipper drum ("feed rate") with a feed rate sensor;
e) determining an instantaneous engine operating rate of the engine ("engine operating rate") with an engine sensor as the chipper drum is rotated;

f) providing a controller that is operatively connected to the feed system and engine and is configured to receive the engine operating rate and to control the feed rate;

g) inputting a maximum engine operating rate, minimum engine operating rate, and intermediate engine operating rate into the controller via an controller interface;

h) modifying the feed rate with the controller based on the instantaneous engine operating rate, wherein the controller causes the feed rate to decline at a first rate of decline as the engine operating rate decreases from the maximum engine operating rate to the intermediate engine operating rate and to decline at a second rate of decline that is greater than the first rate of decline to a non-zero feed rate without changing the direction of the feed conveyor as the engine operating rate decreases from the intermediate engine operating rate.

9. The method of claim 8 further comprising the steps:

a) maintaining the feed rate at the second rate of decline as the engine operating rate decreases from the intermediate engine operating rate to the minimum engine operating rate; and b) modifying the feed rate with the controller to zero without changing the direction of the feed conveyor to stop the wood from advancing further towards the chipper drum once the engine operating rate is below the minimum engine operating rate.

10. The method of claim 8 further comprising the steps of:

a) determining a grinding mode rate of decline of the speed of the feed system as the engine operating rate decreases during operation of the wood chipper from the maximum engine operating rate to the minimum engine operating rate;

b) determine a chipping mode rate of decline of the speed of the feed system as the engine operating rate decreases during operation of the wood chipper from the maximum engine operating rate to the minimum engine operating rate;

c) setting the first rate of decline equal to the chipping mode rate of decline with the controller as the engine operating rate decreases from the maximum engine operating rate to the intermediate engine operating rate;

d) setting the second rate of decline greater than the chipping mode rate and less than the grinding mode rate as the engine operating rate decreases from the intermediate engine operating rate.

11. The method of claim 8 wherein the first rate of decline is proportional with a rate of decrease of the engine operating rate as the engine operating rate decreases during operation of the wood chipper from the maximum engine operating rate to the intermediate engine operating rate.

12. The method of claim 11 wherein the second rate of decline is not proportional with the rate of decrease of the engine operating rate as the engine operating rate decreases during operation of the wood chipper from the intermediate engine operating rate.

13. The method of claim 8 further comprising the step of modifying the feed rate with the controller to zero once the engine operating rate is less than the minimum engine operating rate.

* * * * *